US005347097A

United States Patent [19]

Bolongeat-Mobleu et al.

[11] Patent Number: 5,347,097

[45] Date of Patent: Sep. 13, 1994

[54] ELECTRICAL CIRCUIT BREAKER WITH ROTATING ARC AND SELF-EXTINGUISHING EXPANSION

[75] Inventors: Roger Bolongeat-Mobleu, Echirolles; Peter Malkin, St. Ismier, both of France

[73] Assignee: Merlin Gerin, France

[21] Appl. No.: 101,279

[22] Filed: Aug. 2, 1993

Related U.S. Application Data

[63] Continuation of Ser. No. 731,977, Jul. 18, 1991, abandoned.

[30] Foreign Application Priority Data

Aug. 1, 1990 [FR] France ..... 90 09938

[51] Int. Cl.[5] ..... H01H 33/18; H01H 33/72

[52] U.S. Cl. ..... 200/148 B; 200/147 R

[58] Field of Search ..... 200/144 R, 144 A, 147 R, 200/148 R, 148 B, 148 E; 335/16, 201; 361/2, 14

[56] References Cited

U.S. PATENT DOCUMENTS

| | | | |
|---|---|---|---|
| 4,095,068 | 6/1978 | Meyer et al. | 200/144 AP |
| 4,329,551 | 5/1982 | Bernard et al. | 200/147 R |
| 5,001,313 | 3/1991 | Leclercq et al. | 200/148 B |
| 5,166,483 | 11/1992 | Kersusan et al. | 200/144 A |

FOREIGN PATENT DOCUMENTS

| | | | |
|---|---|---|---|
| 0221838 | 5/1987 | European Pat. Off. | H01H 33/70 |
| 1113024 | 3/1956 | France | H01H 33/98 |
| 2542918 | 9/1984 | France | H01H 33/983 |
| 2623657 | 5/1989 | France | H01H 33/74 |

*Primary Examiner*—A. D. Pellinen
*Assistant Examiner*—Michael A. Friedhofer
*Attorney, Agent, or Firm*—Parkhurst, Wendel & Rossi

[57] ABSTRACT

An arc extinguishing chamber of a pole of an electrical circuit breaker having rotating arc device, the extinguishing chamber operating by self-extinguishing expansion, includes an elongated housing sealed off at both ends by end plates. Coaxially inside the housing there are disposed tubular contacts and a magnetic blowout coil. Along the length of the extinguishing zone defined by the separation distance between the contacts, there is located a sleeve positioned to leave a gap, which allows a top open area of the chamber and a bottom open area of the chamber, located on opposite sides of the extinguishing zone, to communicate. The gap allows the gases to flow between these two areas and fins arranged on a bottom portion of the chamber slow down rotation of the gases to direct them to the extinguishing zone.

12 Claims, 4 Drawing Sheets

ELECTRICAL CIRCUIT BREAKER WITH ROTATING ARC AND SELF-EXTINGUISHING EXPANSION

BACKGROUND OF THE INVENTION

This is a continuation of application Ser. No. 07/731,977 filed Jul. 18, 1991, now abandoned.

The invention relates to a medium or high voltage circuit breaker with rotating arc and self-extinguishing expansion including:

- a sealed enclosure filled with a high dielectric strength gas,
- an arc extinguishing chamber having an elongated housing located the in said enclosure, and sealed off at its ends by first and second end plates respectively,
- a pair of contacts housed in the arc extinguishing chamber and capable of being separated to draw an arc in the extinguishing zone of said chamber,
- a magnetic blowout coil which acts to rotate the arc drawn between the contacts, the coil being located close to the first end plate of the chamber, and
- at least one duct arranged in the contacts to allow gas communication between arc extinguishing chamber and enclosure, and to enable the extinguishing gases to escape from the chamber to the enclosure.

In a circuit breaker of the kind mentioned, the arc is blown out by the gas flow between the arc extinguishing chamber and the external expansion enclosure, via the contacts which are generally tubular-shaped. The efficiency of this pneumatic blowout depends on the volume of the extinguishing chamber which may be large for high voltage circuit breakers, and also on efficient on use of this volume. To this end, it has already been proposed to fit deflectors or shields inside the extinguishing chamber, having the purpose of guiding the gas flow to direct it towards the outflow ducts inside the contacts, or to slow down the rotation of the gases and prevent overpressure and depression zones, liable to affect the dielectric withstand capability in sensitive zones.

The present invention is based on the observation that the gases subjected to the action of an arc in the extinguishing zone are compressed and driven by rotation, which gives rise to an expansion forming a gas plug extending up to the wall of the chamber, partitioning the chamber into two parts. This gas plug or partition prevents any gas flow from one part of the chamber to the other, and is the cause of a partial use of the volume of the extinguishing chamber.

The object of the present invention is to increase the performance of prior circuit breakers, by increasing gas exchange between the two parts of the chamber, despite the presence of this plug located around the extinguishing zone.

SUMMARY OF THE INVENTION

The electrical circuit breaker according to the invention is characterized by a deflector shield, located in the chamber close to the wall of the housing around the extinguishing zone, so as to confine the gases compressed by the action of the arc, leaving a gap between the shield and the wall, a first open area of the chamber, situated between the first end plate and the extinguishing zone, communicates with a second open area of the chamber, situated between the second end plate and said extinguishing zone, via the gap thereby allowing the gases to flow between the first and second open areas of the chamber.

The deflector shield limits the expansion of the gas plug, and allowed communication between the two open areas of the chamber. The gas flow takes place from the first open area of the chamber, located on the coil side and having a smaller volume, towards the second open area of the chamber located on the movable contact side.

According to a development of the invention, this gas exchange is increased by the gases being directed towards the extinguishing zone, this gas return being obtained by fixed fins, supported by the end plate of the chamber on the movable contact side, which slow down or prevent rotation of the gases. The gases are no longer subjected to centrifugal force, and can thus return to the center part, where they flow through the tubular contacts to the expansion enclosure. Efficient blowout is thus achieved using the whole volume of the extinguishing chamber, and preventing any depression in the contact zone, liable to give rise to flashovers or new breakdowns.

The pair of contacts is arranged on the axis of the extinguishing chamber, having an elongated shape. One of the tubular contacts is slidably mounted along this axis. The deflector shield in the form of a sleeve (e.g. a cylindrical sleeve, extends close to the wall of the chamber, and coaxially surrounds the length of the extinguishing zone defined by a gap between the contacts in the open position. The cylindrical sleeve can have a slightly smaller diameter than the chamber housing, also cylindrical in shape, so as to define an annular communication gap between the two open areas of the chamber, situated on either side of this cylindrical sleeve. The sleeve can also be frustum-shaped, the reduced section then being oriented towards the movable contact of the circuit breaker.

According to another embodiment of the invention, the sleeve is cylindrical, and is inserted in a polygonal housing, (e.g., square), such that the sleeve is inscribed within the housing. In this embodiment, a plurality of passages for gas communication between the two parts of the chamber are located at the corners of the housing, which are separated from the cylindrical sleeve. Other embodiments can be used, (e.g., polygonal cross-section sleeves inserted in housings which may or may not be cylindrical) as long as gaps between the sleeve and housing, are present to allow the two open areas of the; chamber situated on either side of the extinguishing zone to communicate. The height of the sleeve is preferably greater than the distance between the contacts in the open position, so as to extend beyond the arc extinguishing zone. This height can notably be close to twice this separating distance, so as to efficiently confine the gases, which expand due to the action of the arc, towards the wall of the housing.

The sleeve advantageously comprises apertures or holes facing the extinguishing zone, enabling metallic particles to pass through to the wall of the housing where they are evacuated to an area removed from the extinguishing zone. The number or dimensions of the fins supported by the end plate are sufficient to hinder rotation of the gases, and these fins, preferably in the form of plates, extend in radial planes, remaining close to the internal surface of the housing. The blowout coil, cylindrical in shape, is associated with the stationary contact, which is preferably tubular, the two contacts passing tightly respectively through the two end plates of the chamber and allow the chamber to communicate with the expansion enclosure, which may be individual to each pole or be common to the three poles of the circuit breaker. In the latter case, the square cross-section of the chamber enables the available volume to be used fully.

In a preferred embodiment, the stationary contact is tubular and the duct internal to the contact communicates via a lateral orifice with the extinguishing chamber. The end plate of the chamber can then be close to or adjoined to the end plate of the enclosure and the height of the enclosure is consequently reduced. The gas compressed by the action of the arc flows inside the stationary contact and prevents any depression liable to draw the arc into the contact. The orifice is close to the end plate of the chamber, on the coil side opposite the extinguishing zone.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
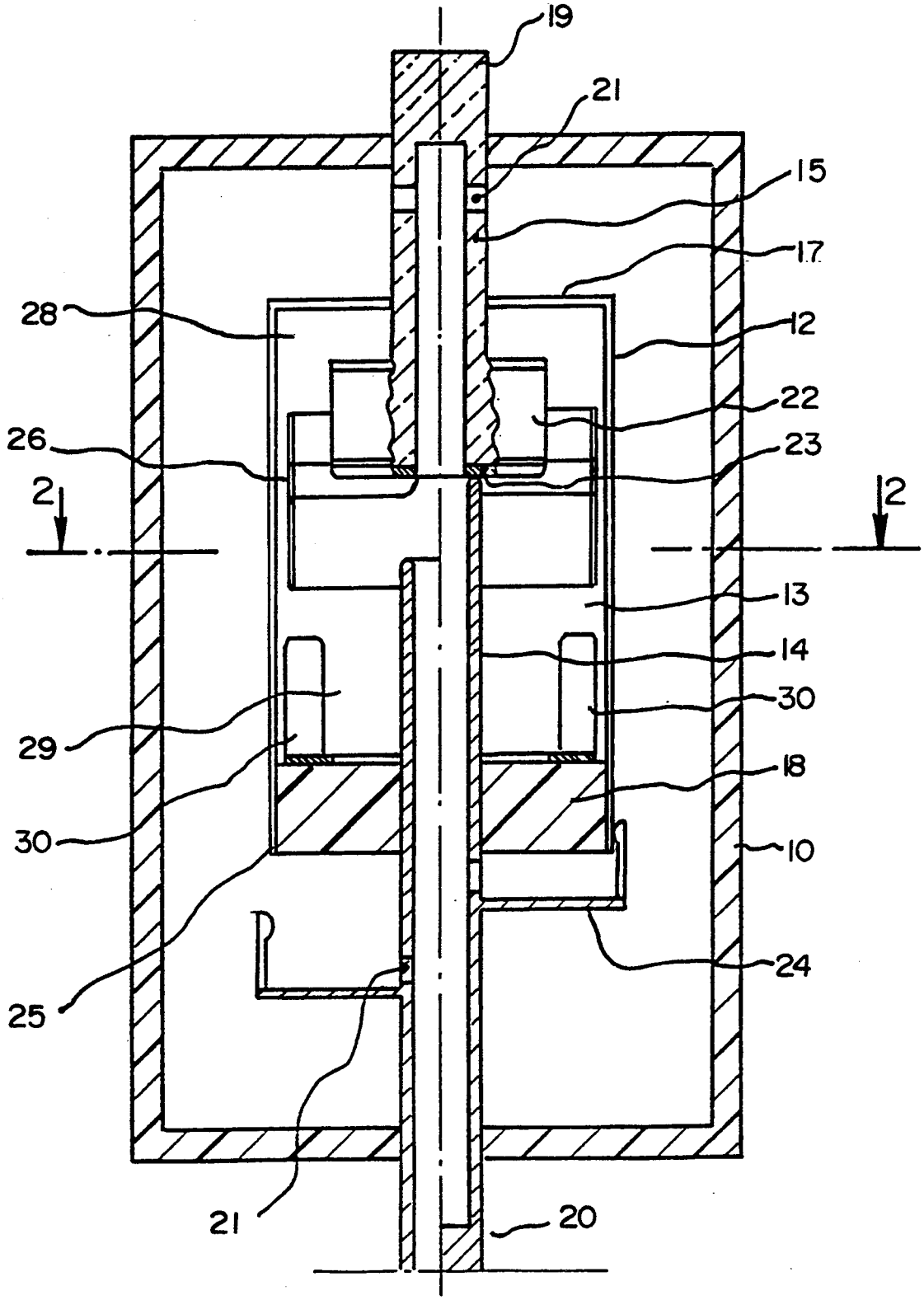
FIG. 1 is a schematic axial section view of a circuit breaker pole according to the invention, represented in the closed position in the right-hand half-view, and in the open position in the left-hand half-view.

In the drawing a pole of a medium or high voltage circuit breaker comprises a sealed enclosure 10, of cylindrical shape, inside of which there is arranged coaxially an elongated housing 12, confining an arc extinguishing chamber 13. A pair of contacts, contact 14 which is movable and tubular, and contact 15 which is stationary and tubular, extend inside the arc extinguishing chamber 13 along to the axis of this chamber 13. The stationary contact 15 passes through the first end plate 17 of the housing 12, whereas the movable contact 14 passes through the second end plate 18 of the chamber 13, each of the contacts 14 and 15 being extended by bushings of the enclosure 10 to be connected to input and output connection terminal pads 19 and 20 of the pole. The tubular contacts 14 and 15 have gas outlet orifices 21 via which the arc extinguishing chamber 13 communicates with the enclosure 10. A magnetic arc blowout coil 22 is coaxially secured outside the stationary contact 15, having, opposite the movable contact 14, an annular electrode 23 for rotation of the arc root. The coil 22 is located near the first end plate 17 of the chamber 13. A circuit breaker of this kind is well-known to those specialized in the art, and it is sufficient to recall that when the contacts 14 and 15 open, the arc drawn between these contacts is subjected to the action of a magnetic field, generated by the coil 22, having current flowing therethrough from flow between terminal pads 19 and 20, and accordingly, flow through contacts 14 and 15. The gases contained in the arc extinguishing chamber 13 are compressed by the action of the arc and escape via the inside of the tubular contacts 14 and 15, via orifices 21 to the expansion enclosure 10.

The pole can, in the manner represented schematically in FIG. 1, comprise main contacts formed by a movable contact 24 securedly united to the movable contact 14, and cooperating with the bottom edge of the housing 12 made of metallic material. The metal housing 12 is electrically connected to the input terminal pad 19. The main contacts 24 and 25 are arranged to separate before the tubular contacts 14 and 15 separate thereby fulfilling the function of arcing contacts. In the closed position of the circuit breaker, almost all the current flows through the closed main contacts 24 and 25. The current is switched through the coil 22 and tubular contacts 14 and 15, drawing an arc therebetween upon separation which is subsequent to separation of the main contacts 24 and 25.

Figure 2:
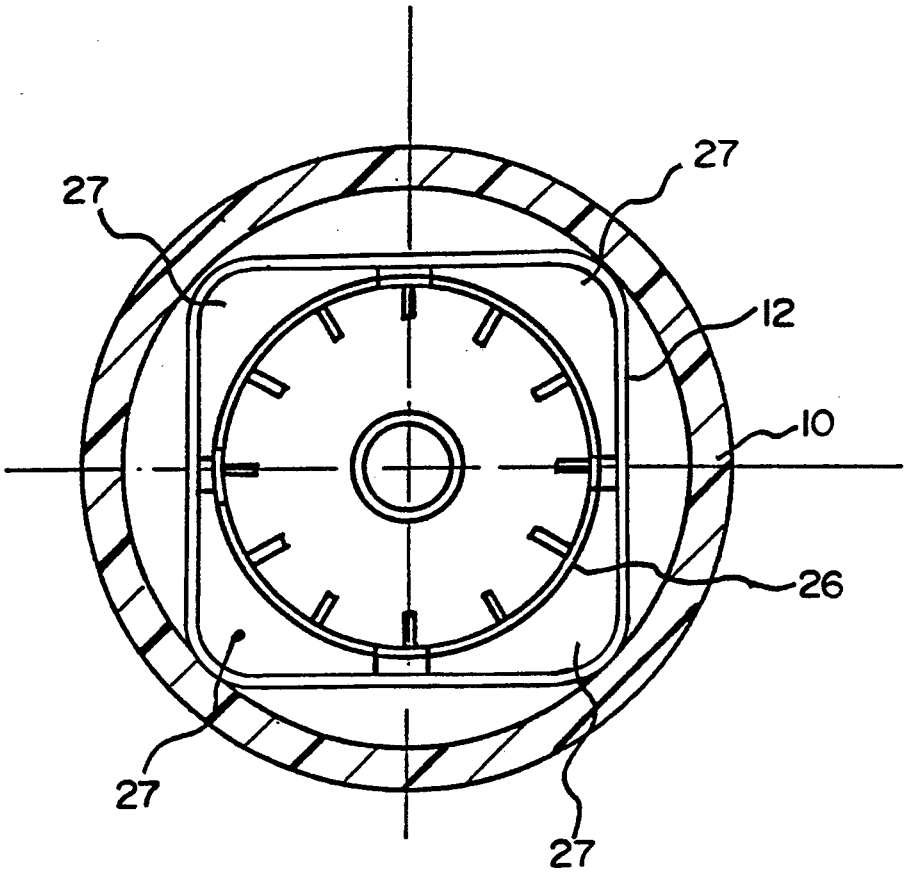
FIG. 2 is a cross-section along the line II—II of FIG. 1.

In the embodiment illustrated by FIGS. 1 and 2, the cross-section of the housing 12 is square, and there is inserted inside this housing 12 a deflector shield 26, formed by a cylindrical sleeve located around the separation zone of the contacts 14 and 15. The deflector shield 26 forming a cylindrical sleeve is contained in the housing 12, leaving in the four corners passages 27 communicating between a first open area 28 of the arc extinguishing chamber situated on the same side as the first end plate 17, and a second open area 29 situated on the same side as the second end plate 18 of the arc extinguishing chamber 13. The axial height of the cylindrical sleeve 26 is greater than the distance separating the contacts 14 and 15 (e.g., close to twice the separation distance), so as to extend beyond the arc extinguishing zone to confine the compressed gases.

The circuit breaker according to the invention operates as follows:

When the contacts 14 and 15 separate, which takes place after the main contacts 24 and 25 have opened, the arc drawn between the separated contacts 14 and 15 is subjected to the rotation generated by the magnetic blowout coil 22, and causes both heating of the gases present in the arc extinguishing zone, and rotation of these gases. These combined effects give rise to expansion of the gases toward the periphery of the arc extinguishing chamber 13, forming a gas plug in the form of a transverse partition, confined by the cylindrical sleeve 26. This gas plug or partition prevents any gas flow between the first open area 28 of the arc extinguishing chamber, and the second open area 29, but this flow can take place in the passages 27 confined between the sleeve 26 and the housing 12. The pressure in the first open area 28 of the arc extinguishing chamber 13 is generally higher than that of the other part of the chamber. This difference is notably due to a volume, differential and the passages 27 enable the gases to be transferred, and therefore the whole volume of the extinguishing chamber to be used. According to a development of the invention, the second end plate 18 bears fins in the form of plates 30, disposed in the second open area 29 of the chamber 13 near the housing 12. These fins 30 slow down or prevent rotation of the gases, and thus divert the gas flow coming from the passages 27 to the arc extinguishing zone, also favoring equalization of the pressure inside the chamber 13, and preventing the formation of large depressions due to a gas swirl effect, which by decreasing the density in the zone near the contacts 14 and 15, may cause breakdown.

It is clear that the shape of the fins 30 and their arrangement inside the chamber 13 can be different, their function being to limit the rotation of the gases inside this chamber. Several extinguishing chambers 13 can be housed in a common enclosure, notably three extinguishing chambers to form a three-pole circuit breaker, the square cross-section of these chambers enabling the available space to be used fully. The cross-section of the extinguishing chamber 13 can be circular, the diameter of the housing 12 of this chamber 13 being slightly greater than that of the coaxial sleeve 26, so as to arrange an annular communication gap between the first open area 28 and the second open area 29 of the chamber 13.

Figure 3:
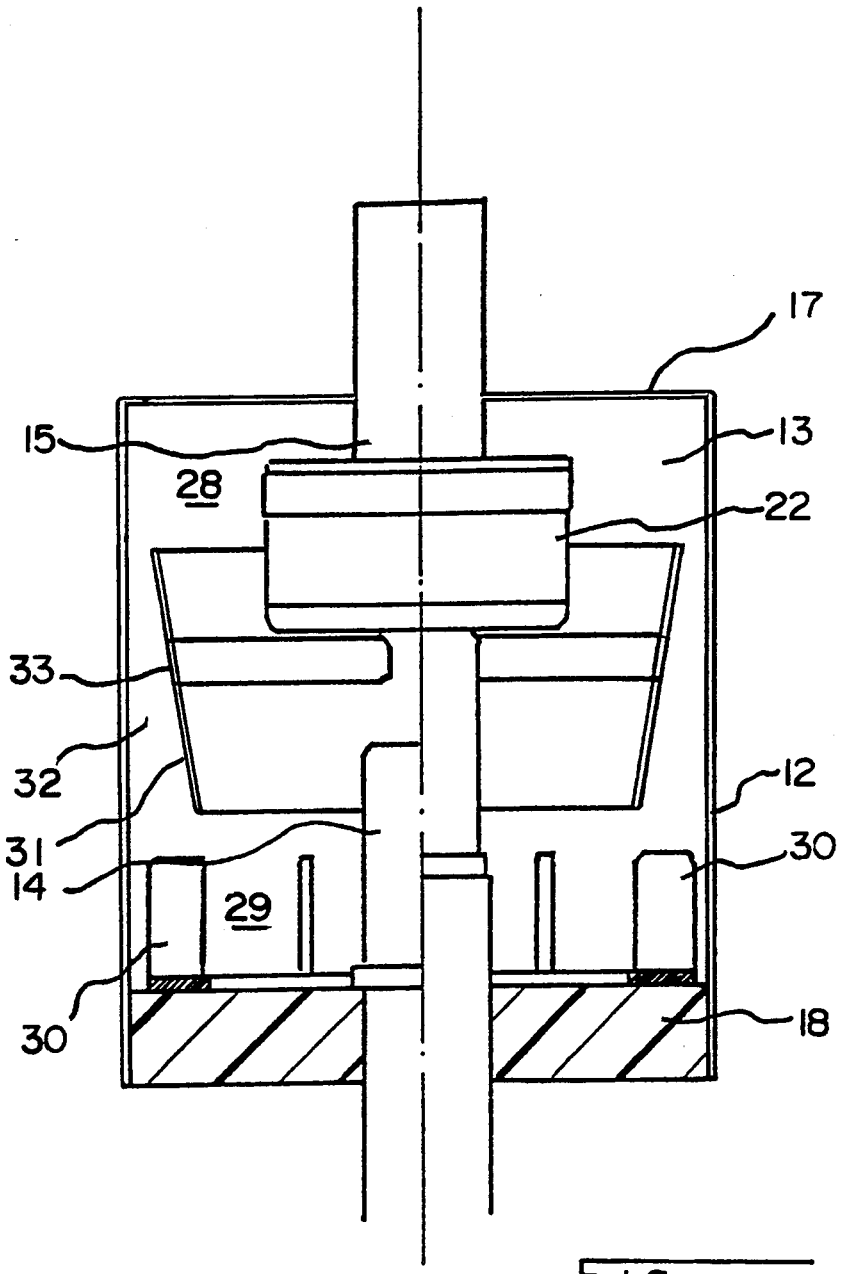
FIG. 3 is a partial view of FIG. 1, illustrating an alternative embodiment of the deflector shield according to the invention.

FIG. 3 illustrates an alternative embodiment of the kind described above, in which the arc extinguishing chamber 13 comprises a cylindrical housing 12, inside which there is arranged a frustum-shaped sleeve 31, whose reduced open area is oriented towards the second end plate 18 of the chamber 13. The gap 32 between the wall 12 and the coaxial frustum-shaped sleeve 31 is downwardly splayed and favors flow of the gases towards the center of the second open area 29 of the chamber 13. This arrangement favors the return of the gases to the extinguishing zone but other arrangements are conceivable. The frustum-shaped sleeve 31 comprises apertures or orifices 33 facing the separation zone of the contacts 14 and 15, enabling metallic particles generated by the action of the arc on the contacts to pass through to the evacuation gap 32 to areas removed from the contacts 14 and 15. This limited outflow does not disturb the gas flow between the first open area 28 of the extinguishing chamber 13 and the second open area 29. It is clear that apertures 33 of this kind can also be arranged in the sleeve 26 of the type illustrated by FIG. 1, or any other similar sleeve.

The sleeves 26 and 31 are advantageously metallic as are the square or circular cross-section housings 12, but it is clear that using sleeves and/or housings 12 made of insulating material would not depart from the spirit of the present invention, in which case it is no longer compulsory for the end plates 17, 18 to be made of insulating material. The invention is in no way limited to the embodiment particularly described herein.

Figure 4:
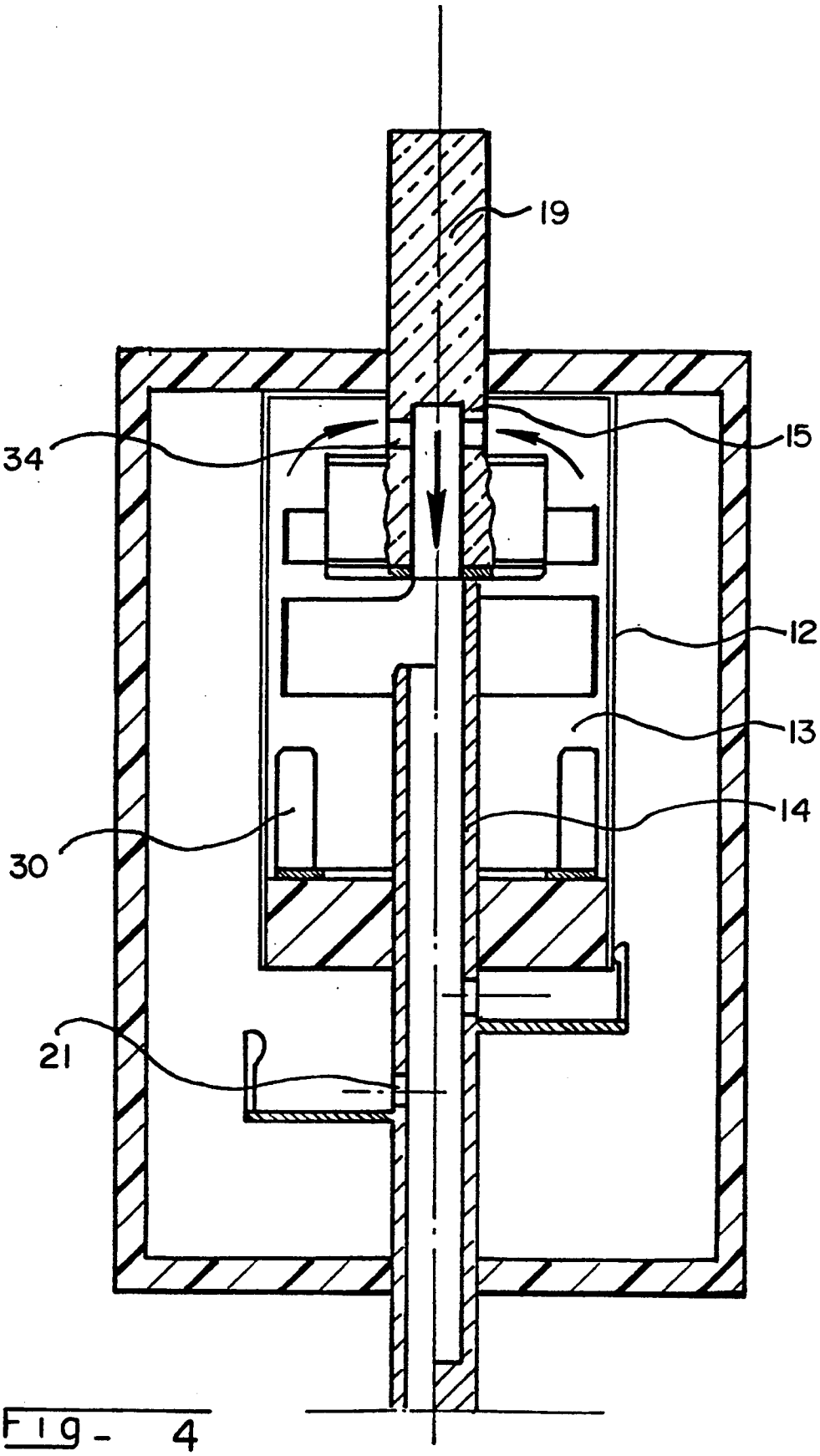
FIG. 4 is a similar view to that of FIG. 1, illustrating an alternative embodiment.

Referring to FIG. 4, it can be seen that the tubular stationary contact 15 is sealed off at its end and that a lateral orifice 34, close to the sealed-off end, makes the inside of the contact 15 communicate with the extinguishing chamber 13. The gas compressed at the periphery of the chamber 13, by the action of the arc, can thus flow through the tubular contact 15, as indicated by the arrows, to the arcing zone. The arc is thus prevented from penetrating into the tubular contact. This arrangement enables the end plate 17 of the chamber 13 to be adjoined to the end plate of the enclosure 10.

We claim:

1. An electrical circuit breaker, comprising:

a sealed enclosure filled with a high dielectric strength gas;

an arc extinguishing chamber having an elongated housing and being sealed off at opposite ends by first and second end plates, respectively, said arc extinguishing chamber being located within said sealed enclosure;

a first contact and a second contact which are adapted to separate from each other to define an open position, wherein a closed position is defined by said first and second contacts being in abutment with each other;

a magnetic blowout coil disposed adjacent said first end plate of the arc extinguishing chamber, said magnetic blowout coil adapted to generate a magnetic field to aid in extinguishing an arc formed upon separation of the first and second contacts;

at least one duct formed in one of said first and second contacts to allow gas communication between the arc extinguishing chamber and the sealed enclosure; and a deflector shield disposed in said arc extinguishing chamber and surrounding said first and second contacts in said closed position, an outer surface of the deflector shield and an inner surface of the arc extinguishing chamber forming a gap therebetween, opposite axial ends of the deflector shield being open to allow gas communication between said sealed enclosure and said deflector shield; wherein said arc extinguishing chamber includes a first open area formed adjacent said first end plate and a second open area formed adjacent said second end plate, said gap allowing gas communication between said first and second open areas.

2. The circuit breaker of claim 1, wherein said deflector shield extends along a separated distance between the first and second contacts in the open position, said deflector shield having a length not less than said separated distance.

3. The circuit breaker of claim 2, wherein said deflector shield has a length of about two times the separated distance.

4. The circuit breaker of claim 1, wherein said second end plate comprises means to slow rotation of the gas, said rotation being induced by said magnetic blowout coil rotating an arc.

5. The circuit breaker of claim 4, wherein said means comprises a plurality of fins extending radially along the second end plate and upwardly from the second end plate into the second open area.

6. The circuit breaker of claim 1, wherein said second contact is tubular and slidable along a central axis of the arc extinguishing enclosure, and wherein the deflector shield is coaxial with the arc extinguishing chamber.

7. The circuit breaker of claim 6, wherein the arc extinguishing chamber and the deflector shield are cylindrical, the diameter of the deflector shield being less than the diameter of the arc extinguishing chamber, wherein the gap formed between the arc extinguishing chamber and the deflector shield is annular.

8. The circuit breaker of claim 6, wherein the cross-section of the arc extinguishing chamber is polygonal and the cross-section of the deflector shield is circular, such that said gap is defined by a plurality of gaps extending along the inside corners of the arc extinguishing chamber.

9. The circuit breaker of claim 6, wherein said deflector shield is frustum-shaped, wherein its apex is located adjacent the second end plate of the arc extinguishing chamber.

10. The circuit breaker of claim 6, wherein the second contact comprises a lateral orifice to provide gas communication between the arc extinguishing chamber and the sealed enclosure via the second contact, said first contact being stationary and tubular, and comprising a lateral orifice to allow gas communication between the arc extinguishing chamber and the sealed enclosure via the first contact.

11. The circuit breaker of claim 1, wherein the deflector shield comprises apertures located opposite a contact point between the first and second contacts to allow metallic particles to pass therethrough.

12. The circuit breaker of claim 1, wherein the magnetic blowout coil is fixed to an interior surface of the first end plate, wherein the magnetic blowout coil comprises an annular electrode defining a stationary contact cooperable with the second contact, said second contact being axially slidable.

* * * * *